US005651388A

United States Patent [19]

Farnan, Jr.

[11] Patent Number: 5,651,388

[45] Date of Patent: Jul. 29, 1997

[54] INDICATING ASSEMBLY FOR USE WITH A FAUCET

[76] Inventor: James F. Farnan, Jr., 3644 Raymond Ave., Brookfield, Ill. 60513

[21] Appl. No.: 391,722

[22] Filed: Feb. 21, 1995

[51] Int. Cl.[6] ..... E03C 1/02

[52] U.S. Cl. ..... 137/551; 40/299; 40/332; 137/801

[58] Field of Search ..... 40/299, 331, 332; 137/551, 801; 285/80, 93

[56] References Cited

U.S. PATENT DOCUMENTS 141,229 7/1873 Matthews .
877,211 1/1908 Meyer .
983,289 2/1911 Kirby .
1,276,735 8/1918 Devney .
1,402,220 1/1922 Deutsch et al. .
1,853,622 4/1932 Kennedy .
2,059,009 10/1936 McCarthy ..... 40/331 X
2,066,877 1/1937 Cruver .

*Primary Examiner*—Gerald A. Michalsky
*Attorney, Agent, or Firm*—Thomas R. Vigil

[57] ABSTRACT

A indicating assembly for use with a faucet having a spout having a threaded distal end portion. The assembly comprises an indicating device which has a mounting portion and an indicating portion and a securing mechanism for securing the indicating device adjacent the distal end portion of the spout.

13 Claims, 2 Drawing Sheets

INDICATING ASSEMBLY FOR USE WITH A FAUCET

BACKGROUND OF THE INVENTION

1. Field of the Invention

The present invention relates to a faucet indicating assembly. The assembly is used with a faucet having a spout and includes an indicating device mounted near the spout and having indicia thereon. The indicating device is securely fastened to the spout and held in place by an attachment such as a lock nut, aerator or serrated hose connector. The indicating device is especially useful for labelling faucets which dispense non-potable water.

2. Description of the Related Art Including Information Disclosed Under 37 CFR §§1.97–1.99

Break tank systems store non-potable or non-drinkable water separately from the drinkable water supply. Break tank systems are well suited for use in laboratories, such as medical research laboratories, and have faucets connected to a break tank for dispensing the non-potable water. Because these faucets dispense non-potable water only, there is a need for them to be labelled or marked as such.

Break tank systems are being used more and more frequently for non-potable water faucets and now are preferred over vacuum break systems in many environments. Water in a break tank system is kept completely separate from the drinkable water supply.

A break tank system has a tank which is filled with water, usually from the drinkable water supply. The water from the tank is pumped out of the tank and distributed to one or more fixtures for dispensing water. The water from the break tank is designated non-potable water.

Prior to break tank systems, vacuum breakers were preferred safety devices for ensuring the drinkable water supply does not become contaminated. Vacuum breakers create a vacuum between the water supply and any water left in the spout of the faucet thereby preventing any contaminated water left in the spout from flowing back into or mixing with the drinkable water supply. Using vacuum breakers, the drinkable water supply would not become contaminated and water from any faucet in the system should be drinkable. However, there are concerns that if the vacuum breaker is not installed properly or if a malfunction occurs the water supply can be contaminated.

Heretofore, various analogous and non-analogous devices and methods of attaching a sign to a faucet or spigot have been proposed. Several examples of such devices are disclosed in the following U.S. Patents:

| U.S. Pat. No. | Patentee |
|---|---|
| 141,229 | Matthews |
| 877,211 | Meyer |
| 983,289 | Kirby |
| 1,276,735 | Devney |
| 1,402,220 | Deutsch et al. |
| 1,853,622 | Kennedy |
| 2,066,877 | Cruver |

The non-analogous Matthews U.S. Pat. No. 141,229 discloses a device for dispensing syrups in soda-water apparatus. The apparatus has a syrup-holder placed within an ice-chamber or cooler and a method for attaching the same to a case. The device includes a body having a faucet which has a collar. The collar is positioned within the case and is drawn against an inner side of a wall of the case by a nut on a screw thread of the device on the outside of the case. A washer is placed between the nut and an outer wall of the case and serves as a seat for the nut. The washer can have a label for the name of the syrup to be dispensed.

The Kirby U.S. Pat. No. 983,289 discloses a sign exhibit attachment for a faucet. The faucet has an operating handle swinging about a horizontal shaft from an open to a closed position. Fixed to the shaft is an arm having a slot therein. A ring is rotatably mounted to a cylindrical portion of the faucet. An arm extends from the ring to the slot in the shaft such that rotation of the shaft will cause rotation of the ring. Two signs are also attached to the ring whereby when the ring is rotated into either the open or closed position, one of the signs is positioned for viewing.

The non-analogous Meyer U.S. Pat. No. 877,211 discloses an urn used in hotels and restaurants where coffee is dispensed in large quantities. The urn has several faucets to dispense the coffee or liquid and signs are shown on the faucet handles.

The non-analogous Devney U.S. Pat. No. 1,276,735 discloses an advertising sign hanger. The hanger is of integral construction and has a head portion, having semi-circular openings therein, and a sign portion integrally formed with the head portion. The semi-circular openings form openings for fitting the hanger over a door knob or the like.

The Deutsch et al. U.S. Pat. No. 1,402,220 discloses an indicator or tag for faucets. The indicator includes a split ring portion having flexible arms adapted to be bent around or just below a nut on the faucet and a channeled skirt portion depending from the front of the ring adapted to fit over a nozzle of the faucet. The arms may have tapered ends to overlap one another. Indicia such as "Hot" or "Cold" can be placed on the front portion of the ring, just above the skirt portion or directly on the skirt portion.

The non-analogous Kennedy U.S. Pat. No. 1,853,622 discloses an advertising medium or tag comprising a message carrying booklet portion and an extension portion having an aperture therethrough for attaching the tag to a door handle or milk bottle.

The Cruver U.S. Pat. No. 2,066,877 discloses a device that is attachable to a faucet or spigot which can be permanently attached to the faucet or spigot and which carries a label or sign which is easily visible to bar patrons. The device includes a U-shaped sheet metal member that has a short arm terminating in a lip extending substantially at a right angle to the short arm, and a long arm which has a sign attached at its outer end. The lip is adapted to be received between a knob or handle and a valve stem of the faucet.

SUMMARY OF THE INVENTION

According to the present invention there is provided a faucet indicating assembly including an indicating device for use with a faucet having a spout. The spout has a threaded distal end portion. The indicating device has a mounting portion and an indicating portion and a securing mechanism for securing the indicating device adjacent the distal end portion of the spout.

DESCRIPTION OF THE PREFERRED EMBODIMENT(S)

Figure 1:
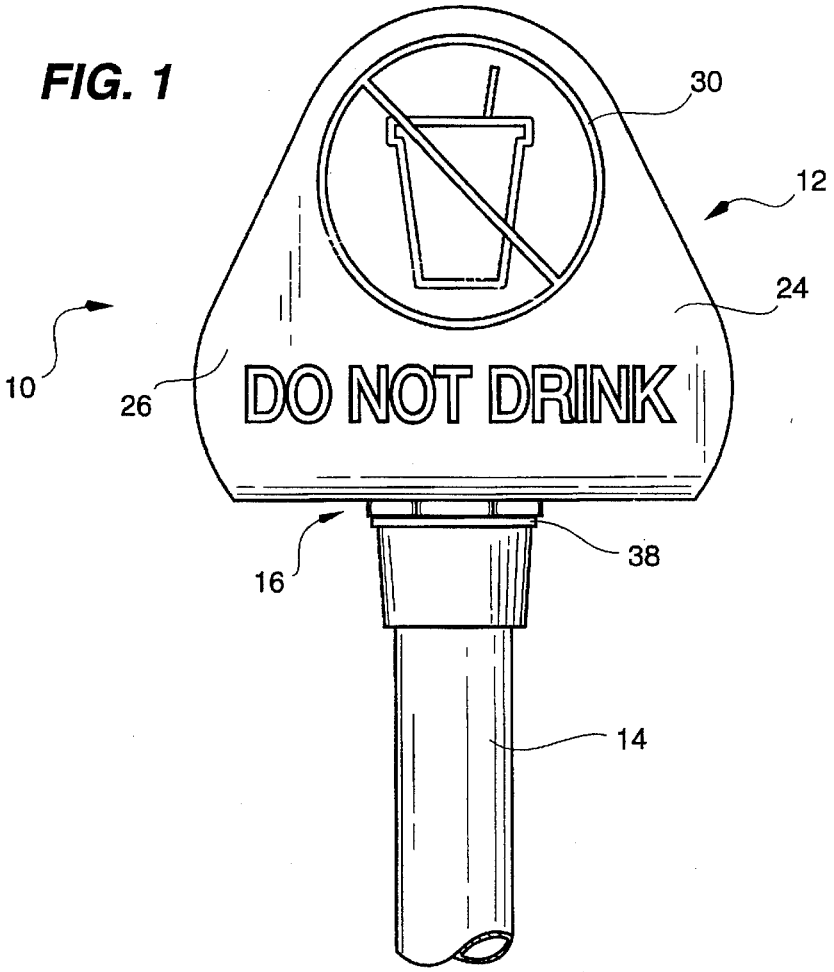
FIG. 1 is a front view of an indicating assembly constructed according to the teachings of the present invention for use with a faucet.

Referring now to FIG. 1, there is shown therein an indicating assembly 10 of the present invention assembled on a faucet. The assembly 10 includes an indicating device 12 on a faucet 14. The faucet 14 is connected to a break tank (not shown) and dispenses non-potable water. The faucet 14 includes a spout 16 having a distal end portion 18 (see FIG. 3) with external threads 20 thereon. The indicating device 12 has a mounting portion 22 and an indicating portion 24 and is mounted at the distal end portion 18 of the spout 16.

The indicating portion 24 of the indicating device 12 is generally planar and has a front surface 26 and a rear surface 28. Indicia 30, such as the wording "DO NOT DRINK" shown in FIG. 1, and/or other wording such as, "NON-POTABLE WATER" OR "NON-DRINKABLE WATER" can be attached to or etched into the front surface 26 of the indicating portion 24 of the indicating device 12 to indicate that non-potable water is dispensed from the faucet 14.

The mounting portion 22 of the indicating device 12, which is generally planar also, and the indicating portion 24 are preferably integrally formed and are bent at an angle to each other when mounted on the spout 16 to allow a person to view the indicia 30 easily from the front of the spout 16.

Figure 4:
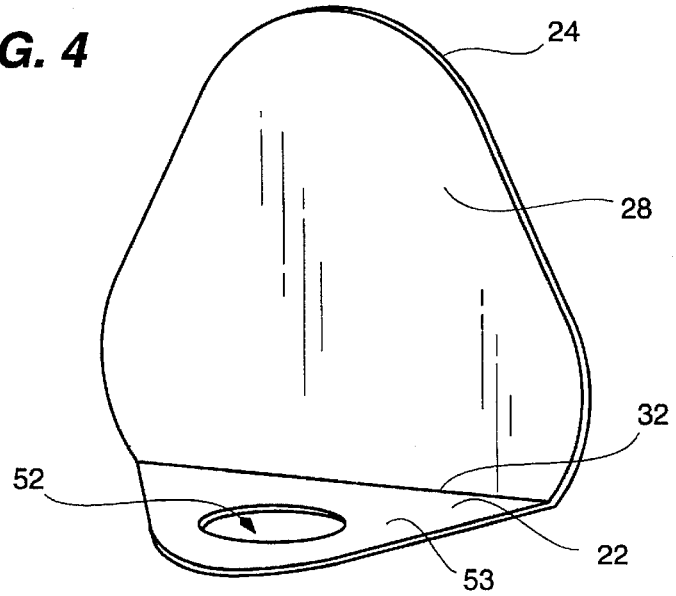
FIG. 4 is a rear perspective view of an indicating device of the indicating assembly shown in FIG. 1.

The indicating device 12 can be made from one piece of metal, i.e., the mounting portion 22 and indicating portion 24 can be stamped as one flat piece. Then the indicating device 12 can be bent along a line 32 (See FIG. 4) on the rear surface 28 of the indicating device 12. Note that the indicating device 12 need not be made of metal and can be made of plastic or any other suitable material.

Figure 2:
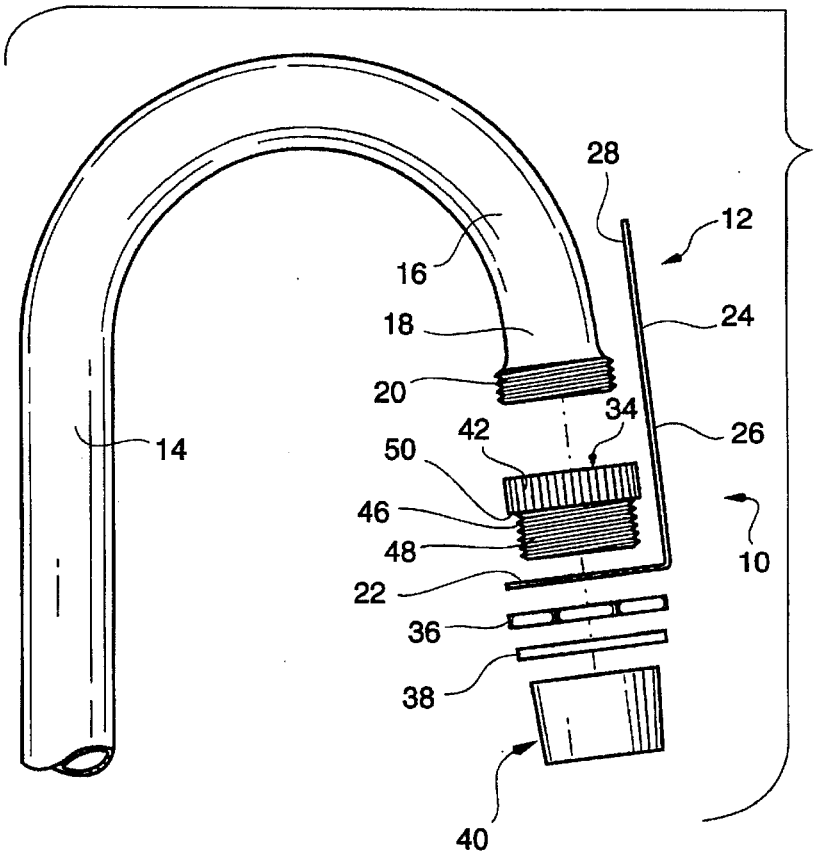
FIG. 2 is an exploded side view of the faucet and of the indicating assembly shown in FIG. 1.

Referring now to FIG. 2, the indicating assembly 10 also includes an adapter 34, a lock nut 36, a washer 38 and an attachment 40 which, as shown in FIGS. 1 and 2, is an aerator 40.

Also, generally, faucet manufacturers design their spouts 16 to have threads 20 of the same size as reciprocal threads of an attachment 40, such as the aerator 40, so that the attachment 40 can be mounted directly onto the spout 16 and a standard adapter (not shown) similar to the adapter 34, is not needed to mount the attachment 40 to the spout 16. Frequently, however, a different size attachment 40, such as one from a different manufacturer, will be attached to the spout 16. The standard adapter is then used to "step down" (or up) the size of the spout threads and enable a smaller (or larger) size attachment 40 to be attached to the spout 16.

The adapter 34 has an annular upper portion 42 with internal threads (not shown) and a smaller in diameter lower portion 46 with external threads 48. The upper portion 42 of the adapter 34 is threadably attached to the spout 16. The upper portion 42 of the adapter 34 also has a lower annular abutment surface 50 and the mounting portion 22 of the indicating device 12 abuts against the abutment surface 50 when it is attached to the spout 16.

The smaller in diameter lower portion 46 of the adapter 34 is preferably longer than lower portions of standard prior art adapters which are used only to "step up" or "step down" the size of the threads 20 on the spout 16. Preferably the lower portion 46 of the adapter 34 is approximately 3/32 inches longer than such standard adapters, in order to accommodate the additional thickness of the lock nut 36 which is approximately 1/16 inch thick. Note, however, that standard adapters can be used.

The mounting portion 22 of the indicating device 12 has a hole 52 therein so that the indicating device 12 can be placed around the threaded lower portion 46 of the adapter 34 and abut against the lower annular abutment surface 50 of the upper portion 42 of the adapter 34. Note that the hole 52 in the mounting portion 22 must be slightly larger than the external threads 48 of the adapter 34.

Preferably, the diameter of the hole 52 is 1/32 inch larger than the diameter of the external threads 48 of the adapter 34. For example, if the diameter of the external threads 48 of the adapter 34 is 13/16 inches, then the diameter of the hole 52 is preferably 27/32 inches.

When the diameter of the aerator 40 is different than the diameter of the spout 16, the adapter 34 can be used to "step down" or "step up" the thread size, i.e. a 13/16 inch female to 1/16 inch male adapter to "step down" the size of the threads 20 or a 13/16 inch female to 15/16 inch male adapter to "step up" the size of the threads 20.

However, when attaching an aerator 40 having the same size threads as the spout 16, the special adapter 34 which does not "step down" (or up) the size of the threads 20, i.e. a one-to-one adapter 34, must be used.

For example, using a Chicago Faucets® brand faucet having 13/16 inch external threads and a Chicago Faucets® brand aerator having 13/16 inch internal threads, a 13/16 inch female to 13/16 inch male adapter must be used.

To assemble the indicating assembly 10 including the indicating device 12, the adapter 34 is first threaded onto the spout 16. Then, the indicating device 12 is placed around the threaded distal end portion 18 of the spout 16 so that a top surface 53 of the mounting portion 22 abuts the annular abutment surface 50 of the adapter 34.

Next, the lock nut 36 is threaded onto the lower portion 46 of the adapter 34 thereby securing the indicating device 12 between the adapter 34 and the lock nut 36 and also preventing the indicating device 12 from rotating about the adapter 34.

Then, the washer 38 is placed over the lower portion 46 of the adapter 34 and against the lock nut 36. Next the aerator 40 is threaded onto the adapter 34, over the washer 38 and lock nut 36, forcing the washer 38 against the lock nut 36 thereby creating a seal to prevent leakage of water from the assembly 10. The washer 38 can be made of any suitable material but preferably is chrome plated with a rubber seat or made of brass.

Note, that the use of the lock nut 36 and/or washer 38 is optional and the indicating device 12 can be secured to the adapter 34 by the attachment 40 only, i.e. an aerator 40, whereby an upper end 54 of the aerator 40 forces the indicating device 12 against the abutment surface 50 of the adapter 34.

Preferably, however, the lock nut 36 and washer 38 are used with the assembly 10 to prevent leakage and to provide the best rotational stability preventing the indicating device 12 from rotating around the lower portion 46 of the adapter 34.

Figure 3:
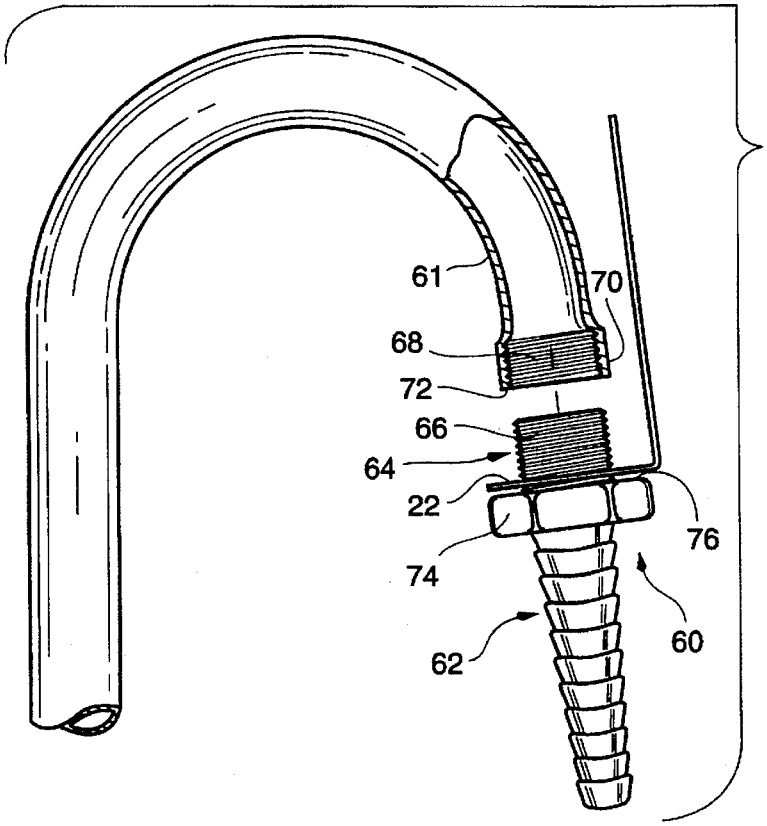
FIG. 3 is an exploded side view of an alternate embodiment of an indicating assembly.

In FIG. 3, an alternative embodiment of an indicating assembly 60 is shown. In this embodiment, an attachment 62 is attached to a spout 61 and the attachment 62 is a serrated hose connector 62 instead of the aerator 40 shown in FIG. 2.

The serrated hose connector 62 has an upper portion 64 with external threads 66. The spout 61 has internal threads 68 which cooperate with the external threads 66 of the hose connector 62.

Also, in the embodiment shown in FIG. 3, no adapter is necessary because a distal end 70 of the spout 61 has an abutment surface 72 and the indicating device 12 can be pressed against the abutment surface 72 of the spout 61.

The serrated hose connector 62 has a larger in diameter annular or hexagonal portion 74 just below the upper portion 64. The hexagonal portion 74 has a top surface 76 which acts as a lower abutment surface 76 for securing the mounting portion 22 of the indicating device 12 between the distal end 70 of the spout 61 and the hose connector 62.

To assemble the indicating assembly 60 shown in FIG. 3, the indicating device 12 is positioned against the abutment surface 72 of the spout 61. Then, the upper portion 64 of the hose connector 62 is placed through the hole 52 in the mounting portion 22 of the indicating device 12 and threaded into the spout 61. The mounting portion 22 of the indicating device 12 is held between the abutment surface 72 of the spout 61 and the abutment surface 76 of the hose connector 62, thereby securing the indicating device 12 to the spout 61.

From the foregoing description, it will be apparent that the indicating assembly 10, 60 of the present invention has a number of advantages, some of which have been described above and others of which are inherent in the invention. Also it will be understood that modifications can be made to the indicating assembly 10, 60 described above without departing from the teachings of the present invention. Accordingly, the scope of the invention is only to be limited as necessitated by the accompanying claims.

I claim:

1. An indicating assembly for use with a faucet having a spout having a threaded distal end portion, said assembly comprising:

an indicating device including a mounting portion and an indicating portion;

an adapter having threaded means for mounting to said threaded distal end portion of the spout and receiving means for receiving said mounting portion; and, securing means for securing said mounting portion of said indicating device to said receiving means of said adapter which is mounted to a distal end portion of the spout.

2. The indicating assembly of claim 1 wherein said adapter has an upper portion with internal threads and a smaller in diameter lower portion with external threads, said upper portion of said adapter being threadably attached to the distal end portion of the spout whereby at least part of said adapter is positioned between the distal end portion of the spout and said indicating device.

3. The indicating assembly of claim 2, wherein said securing means further includes a lock nut, said lock nut being attachable to said lower portion of said adapter.

4. The indicating assembly of claim 3, further including:

a washer mounted adjacent said lock nut; and an aerator mounted on said adapter, said washer being positioned between said lock nut and said aerator.

5. The indicating assembly of claim 2 wherein said securing means further includes an aerator, said aerator being attachable to said lower portion of said adapter.

6. The indicating assembly of claim 2 wherein said indicating device mounting portion has a hole therein whereby said indicating device can be mounted to said adapter by placing said lower portion of said adapter through said hole in said mounting portion of said indicating device.

7. The indicating assembly of claim 1 wherein said mounting portion and said indicating portion are integrally formed and are bent at an angle to each other such that the indicia are easily visible to a person using the faucet.

8. The indicating assembly of claim 1 wherein said indicating portion has "DO NOT DRINK—NON-POTABLE WATER" indicia thereon.

9. The indicating assembly of claim 1 wherein said indicating portion has indicia thereon.

10. The indicating assembly of claim 1 wherein said mounting portion and said indicating portion are made of metal.

11. The indicating assembly of claim 1 wherein said mounting portion and said indicating portion are made of plastic.

12. A method of attaching an indicating device to a faucet having a spout wherein the spout has a threaded distal end portion, comprising the steps of:

mounting an adapter to the threaded distal end portion of the spout;

placing an indicating device on the adapter adjacent the distal end portion of the spout;

providing securing means for securing the indicating device to the adapter; and securing the indicating device to the adapter adjacent the distal end of the spout and between the distal end of the spout and the securing means.

13. A indicating assembly for mounting to a faucet having a spout having a threaded distal end portion, said assembly comprising:

an adapter threadably attached to the distal end portion of the spout;

said adapter having an upper portion and a lower portion, said lower portion being separated from said upper portion by an abutment;

an indicating device mounted on said adapter and contacting said abutment on said adapter; and engaging and securing means for engaging said indicating device and securing said indicating device to said adapter.

* * * * *